United States Patent [19]

Desanto

[11] Patent Number: 4,799,587

[45] Date of Patent: Jan. 24, 1989

[54] STORAGE CASE FOR KEYS WITH PLURAL VELCRO RETAINERS

[76] Inventor: David A. Desanto, 2205 Lydia Pl., Vienna, Va. 22180

[21] Appl. No.: 875,224

[22] Filed: Jun. 17, 1986

[51] Int. Cl.[4] ..... A45C 11/00

[52] U.S. Cl. ..... 206/37.6; 70/456 B; 206/37.8; 206/459; 206/472; 248/205.2

[58] Field of Search ..... 206/37.1–37.8, 206/472, 459, 478, 479, 482; 24/3 K, 306, 442; 229/250, 253, 901; 248/205.2; 70/456 R, 456 B

[56] References Cited

U.S. PATENT DOCUMENTS

| | | | |
|---|---|---|---|
| 1,719,120 | 7/1929 | Miles | 206/37.4 |
| 1,941,746 | 1/1934 | Hill | 206/459 |
| 2,605,802 | 8/1952 | Baldwin | 206/37.4 |
| 3,294,137 | 12/1966 | Rubenstein | 206/37.4 |
| 3,318,354 | 5/1967 | Borisof | 206/38.1 |
| 3,415,300 | 12/1968 | Worcester | 248/205.2 X |
| 3,568,482 | 3/1971 | Shears | 70/456 B |
| 4,024,997 | 5/1977 | Kolpin | 224/901 X |
| 4,072,033 | 2/1978 | Eckerdt | 70/456 B |
| 4,139,133 | 2/1979 | Repka | 229/901 X |

*Primary Examiner*—Stephen Marcus
*Assistant Examiner*—Bryon Gehman
*Attorney, Agent, or Firm*—Bacon & Thomas

[57] ABSTRACT

A storage case for keys including a pair of hinged walls securable together in a folded position by a zipper and including internal support surfaces provided with a plurality of spaced retainers, with each retainer being defined by a flexible loop for detachably supporting a key ring thereon.

5 Claims, 1 Drawing Sheet

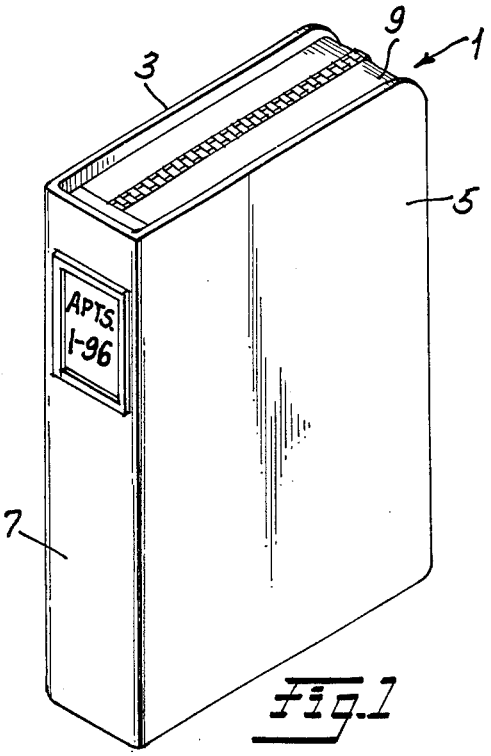
Fig. 1
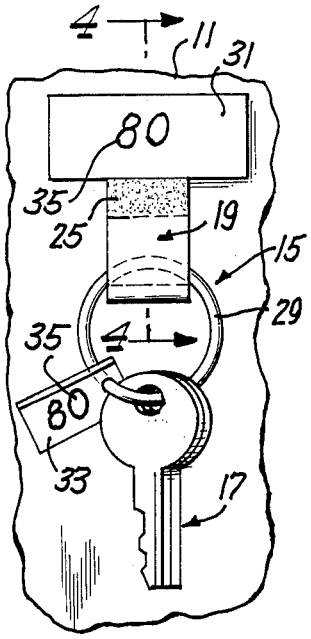
Fig. 3
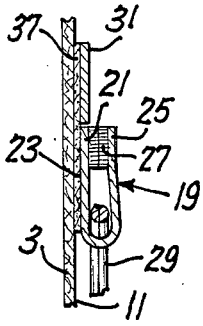
Fig. 4
Fig. 2
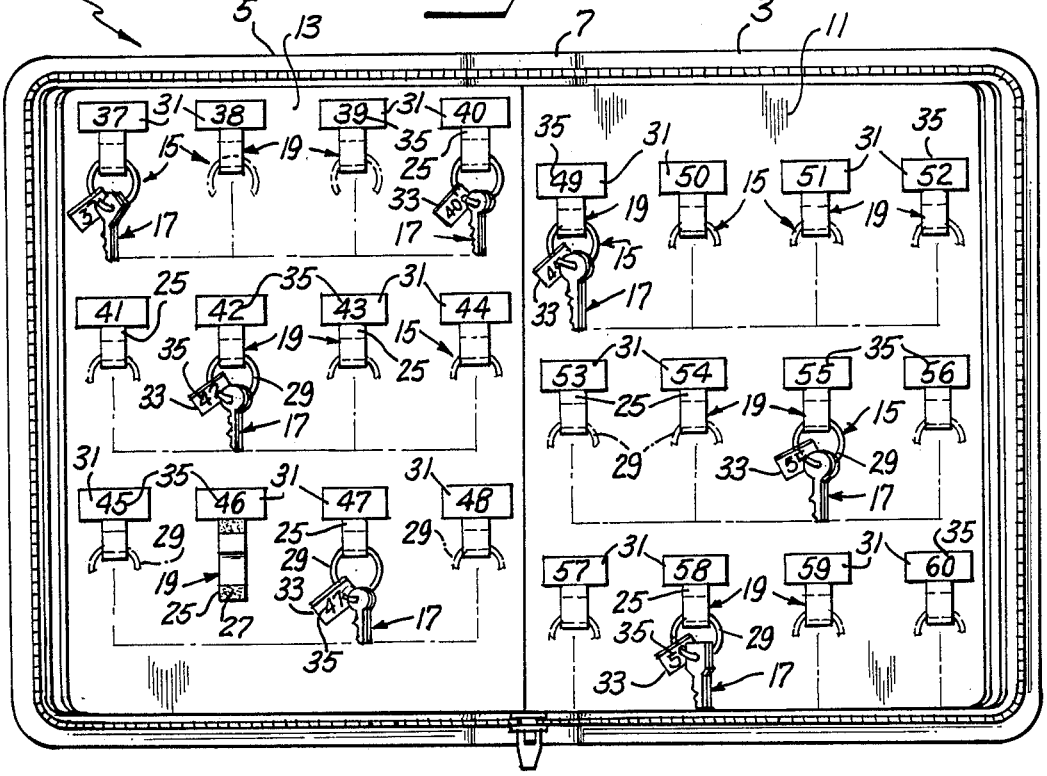

STORAGE CASE FOR KEYS WITH PLURAL VELCRO RETAINERS

BACKGROUND OF THE INVENTION

1. Field of the Invention

The present invention generally involves the field of technology pertaining to storage cases for small articles. More specifically, the invention relates to an improved case for storing a plurality of keys.

2. Description of the Prior Art

There are many different kinds of devices for storing a plurality of keys whereby the keys may be individually accessed for use when required. One such device is in the form of a case defined by a pair of hinged wall sections which may be folded in the manner of a book and secured in the folded position by means of a slide fastener which extends substantially around three corresponding edges of the wall sections. At least one wall section is provided with an interior surface on which a plurality of hooks are attached for detachably securing one or more keys on each hook. Key cases of this type are typically of small size so that they may be easily carried in a purse or a pocket for personal use. These cases are usually provided with a single row of hooks which, when filled with plural keys, causes the case to bulge or become distorted. Moreover, keys stored in this manner are difficult to identify and selectively access when needed. Finally, the conventional hook structures used to secure keys in cases of this type are difficult and time consuming to operate when removing or adding keys.

Examples of known devices for storing keys, including key cases of the aforedescribed type, are exemplified by the Bushnell U.S. Pat. No. 1,543,054; Gardner U.S. Pat. No. 2,032,408; Loew U.S. Pat. No. 2,482,422; and Rubenstein U.S. Pat. No. 3,294,137.

SUMMARY OF THE INVENTION

It is an object of the invention to provide an improved case for storing a plurality of keys wherein the keys may be quickly and easily added to or removed from the case.

It is another object of the invention to provide an improved storage case for a large number of keys wherein the individual keys may be readily identified and accessed for use when desired.

It is a further object of the invention to provide an improved key storage case having a plurality of retainers which permit a large number of keys to be rapidly added to or removed from the case in a selective manner.

These and other objects of the invention are realized by providing a key case which is defined by a pair of rectangular members which are hinged together along a pair of corresponding edges, thereby permitting the members to be placed in open and folded positions in the manner of a book. The remaining three corresponding edges of the members are provided with a slide fastener which may be zipped to secure the members in the folded position or unzipped to permit the members to be disposed in the open position. The internal surfaces of the members are each provided with a plurality of spaced retainers extending across substantially the entire areas thereof. Each retainer is defined by a flexible elongate strap having a first end attached to a corresponding internal surface of a member and a second free end which may be detachably secured to the first end by means of cooperating fastening means carried by both ends. This permits the strap to for a loop on which a key ring, containing one or more keys, may be detachably supported in the case. The key strap and key ring of each retainer are each preferably provided with correlating indicia means to permit quick visual identification of the desired key for its selective removal from and addition to the case.

Other objects, features and advantages of the invention shall become apparent from the detailed description of a preferred embodiment thereof, when considered in conjunction with the drawings wherein like reference characters designate corresponding parts in the several views.

BRIEF DESCRIPTION OF THE DRAWINGS

FIG. 1 is a pictorial view of a key storage case according to a preferred embodiment of the present invention;

FIG. 2 is an enlarged elevational view showing the storage case in its open position and particularly depicting the arrangement and function of the individual key retainers;

FIG. 3 is an enlarged fragmentary elevational view of a single key retainer provided with indicia means and shown with plural keys retained thereon; and FIG. 4 is a fragmentary vertical sectional view, taken on the line 4—4 of FIG. 3, showing the indicia means and cooperative fastening means associated with the elongate strap of the retainer.

DETAILED DESCRIPTION OF THE PREFERRED EMBODIMENT

A key storage case 1, according to a preferred embodiment of the invention, shall now be described with initial reference to FIGS. 1 and 2. As shown therein, case 1 is defined by a pair of rectangular members 3 and 5 which are hinged together along a pair of corresponding edges by means of a spine 7 or any other appropriate hinge construction. The remaining three pairs of corresponding edges of members 3 and 5 are preferably provided with a slide fastener 9 of known construction, such as a zipper, for securing members 3 and 5 in a folded position, as shown in FIG. 1.

Access to the interior of case 1 is realized by releasing slide fastener 9, thereby permitting members 3 and 5 to be pivoted into an open position in the manner of a book, as particularly shown in FIG. 2. Member 3 is provided with a support surface 11. Similarly, member 5 is also provided with an internal support surface 13. A plurality of key retainers 15 are attached to internal surfaces 11 and 13 for the purpose of releasably storing a plurality of different keys in case 1. Retainers 15 are spaced from each other and preferably extend across substantially the entire areas of support surfaces 11 and 13. As is therefore evident, individual or plural keys, shown generally at 17, may be detachably secured to each retainer 15, with keys 17 being readily identifiable and accessible for use when desired by virtue of the spaced disposition of retainers 15.

The structural details of each retainer 15 shall now be described with particular reference to FIGS. 3 and 4. As shown, retainer 15 includes an elongate flexible strap 19 having a first end 21 attached to support surface 11 by a layer of appropriate adhesive 23. Alternatively, rivets or other suitable mechanical fasteners may also be utilized as equivalent substitutes for adhesive 23. Strap 19 also includes a second end 25 which is detachably secured to end 21 by an appropriate fastening means 27, such as a Velcro connector, with cooperating portions of fastening means 27 being carried by ends 21 and 25. Alternatively, other types of fastening means well known in the art, including snap button or clasp assemblies, may also be utilized for this purpose.

When first and second ends 21 and 25 of strap 19 are secured together as shown, strap 19 defines a loop for supporting a key ring 29 of conventional design thereon. Ring 29 may be of the single loop or coiled ring type on which one or more keys 17 may be affixed. Removal of ring 29 and its associated keys 17 from case 3 only requires detachment of second end 25 from first end 21 of strap 19. It is preferred that strap 19 be formed of an appropriate flexible material, such as leather or plastic. The structural details of retainer 15 described herein are of course the same for all retainers 15 attached to support surfaces 11 and 13 of members 3 and 5, respectively.

The construction of storage case 1 as described herein renders immediately apparent the advantages afforded thereby when compared to known devices of this type. The spacing of a large number of retainers 15 across support surfaces 11 and 13 permit the easy storage and identification of, and accessibility to, a large number of different keys in a manner that is incapable of being realized with conventional key cases.

Storage case 1 is particularly useful in business applications, such as real estate or apartment sales and management, wherein a large number of different keys must be conveniently stored and quickly identified for frequent use. In accommodating such requirements, it is also preferred that each retainer 15 be provided with indicia means for visual identification, as shown in FIG. 3, including a stationary tag 31 that is permanently secured to surface 11 adjacent retainer 15 and a portable tag 33 attached to ring 29. Tags 31 and 33 are each provided with a common indicia 35 which permits instant visual correlation of ring 29 with its corresponding strap 19. In this way, instant visual identification, removal or addition of desired keys 17 with respect to case 3 can be advantageously realized. As seen in FIG. 4, tag 31 may be secured to surface 11 by a layer of an appropriate adhesive 37. Tags 31 and 33 may be of plastic, cardboard, metal or other material deemed suitable for the practice of the invention as disclosed herein.

It is to be understood that the embodiment of the invention herein shown and described is to be taken as a preferred example of the same, and that various changes in shape, size, arrangement of parts, compositions and method of practice may be resorted to without departing from the spirit of the invention or scope of the subjoined claims.

I claim:

1. An improved storage case for keys comprising:
(a) a pair of rectangular members hinged together for pivotal movement between open and folded positions;
(b) means for securing the members in the folded position;
(c) each member including an internal support surface;
(d) a plurality of vertically and horizontally spaced retainers nondetachably secured to each support surface, each retainer for detachably securing an individual key holder;
(e) an individual key holder for detachable connection to each retainer;
(f) each retainer being defined by an elongate strap including a first end attached to the support surface and a free second end, and cooperating Velcro means carried by the first and second ends for permitting their overlapping detachable connection to define a loop for receiving and supporting the separate key holder, whereby the key holder may be quickly secured to or separated from the retainer through connection and disconnection of the first second ends; and
(g) first indicia means carried by each retainer and second indicia means carried by each separate key holder for permitting visual identification and correlation of each separate key holder with respect to its corresponding retainer.

2. The storage case of claim 1 wherein each elongate strap is formed from a flexible material.

3. The storage case of claim 2 wherein the flexible material includes leather.

4. The storage case of claim 1 wherein the key holder is a key ring.

5. The storage case of claim 1 wherein the means for securing the members in the folded position includes a slide fastener extending along three corresponding edges of the members.

* * * * *